US007002299B2

(12) United States Patent
Kawaguchi et al.

(10) Patent No.: US 7,002,299 B2
(45) Date of Patent: Feb. 21, 2006

(54) DISCHARGE LAMP WITH SPECIFIC AMOUNTS OF HALOGEN, OXYGEN, HYDROGEN AND CARBON

(75) Inventors: Masataka Kawaguchi, Hyogo-ken (JP); Motoko Uramoto, Hyogo-ken (JP); Dan Masashi, Hyogo-ken (JP); Yoshihiro Horikawa, Hyogo-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 256 days.

(21) Appl. No.: 10/697,090

(22) Filed: Oct. 31, 2003

(65) Prior Publication Data

US 2004/0090183 A1 May 13, 2004

(30) Foreign Application Priority Data

Nov. 1, 2002 (JP) ..... 2002-319980

(51) Int. Cl.
*H01J 61/12* (2006.01)

(52) U.S. Cl. ..... 313/637; 313/639; 313/567; 313/576; 445/26

(58) Field of Classification Search ..... 313/637
See application file for complete search history.

(56) References Cited

U.S. PATENT DOCUMENTS 6,271,628 B1 * 8/2001 Sugitani et al. ..... 313/637
6,669,522 B1 * 12/2003 Nishida ..... 445/26

FOREIGN PATENT DOCUMENTS

JP 11-329350 A 11/1999
JP 2002-075269 A 3/2002

* cited by examiner

*Primary Examiner*—Karabi Guharay
*Assistant Examiner*—Sikha Roy
(74) *Attorney, Agent, or Firm*—David S. Safran

(57) ABSTRACT

A discharge lamp which maintains a high lumen maintenance factor even when operated for a long time is obtained in a discharge lamp which has a silica glass discharge vessel and a pair of opposed electrodes in the discharge vessel and in which the discharge vessel is filled with at least 0.15 mg/mm$^3$ mercury, a rare gas with argon as the main component, and $2\times10^{-4}$ $\mu$mole/mm$^3$ to $7\times10^{-3}$ $\mu$mole/mm$^3$ bromine by meeting the following conditions when feeding a direct current of 5 mA between the electrodes and a glow discharge produced:

$1.0\times10^{-4} \leqq b/a \leqq 1.2\times10^{-1}$ Condition (1)

$c/a \leqq 1.4\times10^{-1}$ Condition (2)

$d/a \leqq 1.2\times10^{-2}$ Condition (3)

$e/a \leqq 1.4\times10^{-2}$ Condition (4)

where a is the emission intensity of the argon with a wavelength of 668 nm, b is the emission intensity of OH with a wavelength of 309 nm, c is the emission intensity of hydrogen (H) with a wavelength of 656 nm, d is the emission intensity of $C_2$ with a wavelength of 517 nm, and e is the emission intensity of CH with a wavelength of 431 nm.

8 Claims, 4 Drawing Sheets

Fig. 2
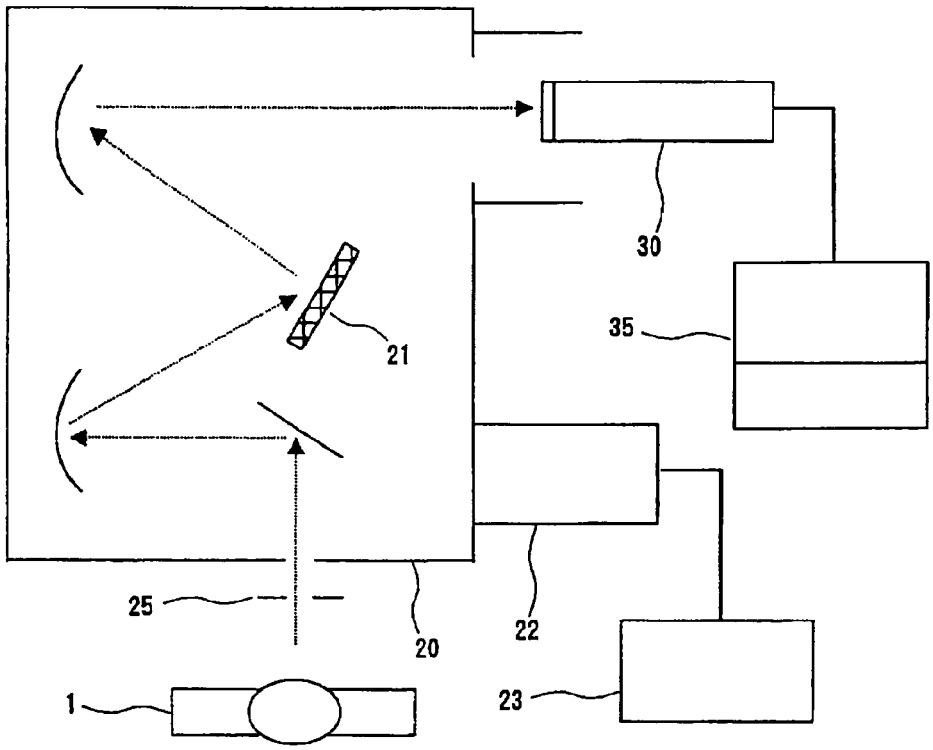
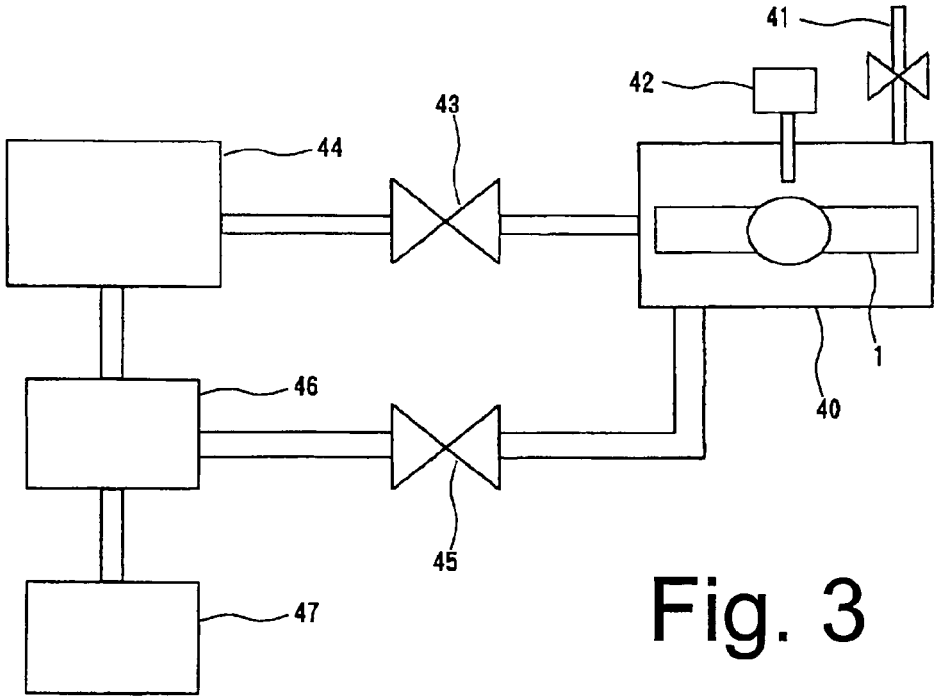
Fig. 3

Fig. 4

| | Mixing ratio of the encapsulated gases $O_2$/Ar (%) | Condition for the degassing treatment of the material of which the discharge vessel is formed | Condition for the thermal treatment of the electrodes | Ratio b/a | Ratio c/a | Ratio d/a | Ratio e/a | Lumen maintenance factor (%) | Value of the increase of the voltage (V) | Concentration of the carbon compounds (ppm) | Evaluation |
|---|---|---|---|---|---|---|---|---|---|---|---|
| 1 (comparison) | 0 | G 1 | H 3 | $3.0 \times 10^{-5}$ | $1.6 \times 10^{-1}$ | $2.1 \times 10^{-4}$ | $4.0 \times 10^{-4}$ | 37 | 13.0 | | X |
| 2 (comparison) | 0 | G 3 | H 1 | $6.5 \times 10^{-5}$ | $6.0 \times 10^{-3}$ | $4.0 \times 10^{-2}$ | $8.8 \times 10^{-4}$ | 44 | 9.0 | | X |
| 3 (comparison) | 0 | G 3 | H 3 | $9.7 \times 10^{-6}$ | $4.0 \times 10^{-3}$ | $6.0 \times 10^{-4}$ | $3.9 \times 10^{-4}$ | 47 | 8.5 | | X |
| 4 (comparison) | 0.1 | G 1 | H 1 | $2.5 \times 10^{-5}$ | $2.2 \times 10^{-1}$ | $6.9 \times 10^{-4}$ | $3.6 \times 10^{-2}$ | 55 | 11.0 | 3000 | X |
| 5 (comparison) | 0.1 | G 1 | H 2 | $2.0 \times 10^{-4}$ | $1.8 \times 10^{-1}$ | $1.5 \times 10^{-4}$ | $4.5 \times 10^{-3}$ | 48 | 11.5 | | X |
| 6 (comparison) | 0.1 | G 1 | H 3 | $1.5 \times 10^{-4}$ | $1.9 \times 10^{-1}$ | $2.7 \times 10^{-4}$ | $4.8 \times 10^{-4}$ | 44 | 8.0 | | X |
| 7 (comparison) | 0.1 | G 2 | H 1 | $3.0 \times 10^{-4}$ | $2.7 \times 10^{-2}$ | $5.5 \times 10^{-4}$ | $4.0 \times 10^{-2}$ | 50 | 9.5 | 600 | X |
| 8 (invention) | 0.1 | G 2 | H 2 | $4.5 \times 10^{-4}$ | $5.4 \times 10^{-2}$ | $3.1 \times 10^{-4}$ | $1.2 \times 10^{-2}$ | 83 | 8.0 | 300 | O |
| 9 (invention) | 0.1 | G 2 | H 3 | $3.5 \times 10^{-4}$ | $1.4 \times 10^{-1}$ | $4.4 \times 10^{-4}$ | $6.3 \times 10^{-4}$ | 87 | 15.0 | 200 | O |
| 10 (comparison) | 0.1 | G 3 | H 1 | $2.0 \times 10^{-4}$ | $7.2 \times 10^{-3}$ | $4.8 \times 10^{-2}$ | $5.5 \times 10^{-4}$ | 52 | 12.0 | | X |
| 11 (invention) | 0.1 | G 3 | H 2 | $1.0 \times 10^{-4}$ | $4.5 \times 10^{-3}$ | $4.5 \times 10^{-3}$ | $1.8 \times 10^{-4}$ | 85 | 11.0 | 400 | O |
| 12 (invention) | 0.1 | G 3 | H 3 | $1.5 \times 10^{-4}$ | $4.8 \times 10^{-3}$ | $7.2 \times 10^{-4}$ | $3.3 \times 10^{-4}$ | 90 | 7.5 | 100 | O |
| 13 (comparison) | 0.5 | G 1 | H 1 | $6.0 \times 10^{-4}$ | $2.1 \times 10^{-1}$ | $5.0 \times 10^{-4}$ | $3.4 \times 10^{-2}$ | 43 | 25 | | X |
| 14 (comparison) | 0.5 | G 1 | H 2 | $5.3 \times 10^{-3}$ | $2.1 \times 10^{-1}$ | $8.1 \times 10^{-4}$ | $5.2 \times 10^{-3}$ | 39 | 15 | | X |
| 15 (comparison) | 0.5 | G 1 | H 3 | $3.4 \times 10^{-3}$ | $1.9 \times 10^{-1}$ | $4.5 \times 10^{-4}$ | $4.8 \times 10^{-4}$ | 45 | 16 | | X |
| 16 (comparison) | 0.5 | G 2 | H 1 | $7.2 \times 10^{-4}$ | $6.0 \times 10^{-2}$ | $3.6 \times 10^{-4}$ | $3.8 \times 10^{-2}$ | 50 | 14 | 1000 | X |
| 17 (invention) | 0.5 | G 2 | H 2 | $1.2 \times 10^{-2}$ | $1.1 \times 10^{-1}$ | $7.5 \times 10^{-4}$ | $1.4 \times 10^{-2}$ | 92 | 12 | 500 | O |
| 18 (invention) | 0.5 | G 2 | H 3 | $7.9 \times 10^{-3}$ | $6.0 \times 10^{-2}$ | $5.8 \times 10^{-4}$ | $6.4 \times 10^{-4}$ | 90 | 8.5 | 300 | O |

Fig. 5

| | Mixing ratio of the encap-sulated gases $O_2$/Ar (%) | Condition for the degas-sing treatment of the material of which the discharge vessel is formed | Condition for the thermal treatment of the electrodes | Ratio b/a | Ratio c/a | Ratio d/a | Ratio e/a | Lumen maintenance factor (%) | Value of the increase of the voltage (V) | Concentra-tion of the carbon compounds (ppm) | Evaluation |
|---|---|---|---|---|---|---|---|---|---|---|---|
| 19 (comparison) | 0.5 | G 3 | H 1 | $4.8 \times 10^{-3}$ | $6.8 \times 10^{-3}$ | $4.6 \times 10^{-2}$ | $7.6 \times 10^{-4}$ | 48 | 23 | | X |
| 20 (invention) | 0.5 | G 3 | H 2 | $2.6 \times 10^{-3}$ | $5.2 \times 10^{-2}$ | $5.2 \times 10^{-3}$ | $1.3 \times 10^{-4}$ | 88 | 16 | 500 | O |
| 21 (invention) | 0.5 | G 3 | H 3 | $3.4 \times 10^{-3}$ | $4.8 \times 10^{-3}$ | $7.3 \times 10^{-4}$ | $3.3 \times 10^{-4}$ | 92 | 12 | 320 | O |
| 22 (comparison) | 1 | G 1 | H 1 | $4.8 \times 10^{-3}$ | $2.0 \times 10^{-1}$ | $5.0 \times 10^{-4}$ | $4.1 \times 10^{-2}$ | 36 | 14 | | X |
| 23 (comparison) | 1 | G 1 | H 2 | $1.1 \times 10^{-1}$ | $2.4 \times 10^{-1}$ | $8.3 \times 10^{-4}$ | $5.3 \times 10^{-3}$ | 51 | 8 | 900 | X |
| 24 (comparison) | 1 | G 1 | H 3 | $4.0 \times 10^{-2}$ | $2.0 \times 10^{-1}$ | $1.2 \times 10^{-4}$ | $4.8 \times 10^{-4}$ | 37 | 7.5 | | X |
| 25 (comparison) | 1 | G 2 | H 1 | $5.8 \times 10^{-3}$ | $5.9 \times 10^{-2}$ | $6.0 \times 10^{-4}$ | $4.6 \times 10^{-2}$ | 45 | 11 | | X |
| 26 (invention) | 1 | G 2 | H 2 | $9.5 \times 10^{-2}$ | $1.3 \times 10^{-1}$ | $9.0 \times 10^{-4}$ | $9.0 \times 10^{-3}$ | 90 | 12.5 | 600 | O |
| 27 (invention) | 1 | G 2 | H 3 | $6.5 \times 10^{-2}$ | $9.0 \times 10^{-2}$ | $1.0 \times 10^{-4}$ | $6.3 \times 10^{-4}$ | 87 | 16 | 150 | O |
| 28 (comparison) | 1 | G 3 | H 1 | $7.2 \times 10^{-2}$ | $6.7 \times 10^{-3}$ | $5.5 \times 10^{-2}$ | $4.0 \times 10^{-4}$ | 46 | 25 | | X |
| 29 (invention) | 1 | G 3 | H 2 | $5.2 \times 10^{-2}$ | $6.0 \times 10^{-3}$ | $1.2 \times 10^{-2}$ | $3.3 \times 10^{-4}$ | 89 | 14 | 300 | O |
| 30 (invention) | 1 | G 3 | H 3 | $1.2 \times 10^{-1}$ | $5.1 \times 10^{-3}$ | $7.2 \times 10^{-4}$ | $4.5 \times 10^{-4}$ | 91.5 | 8.5 | 440 | O |
| 31 (comparison) | 2 | G 1 | H 3 | $2.5 \times 10^{-1}$ | $2.0 \times 10^{-1}$ | $1.4 \times 10^{-4}$ | $4.0 \times 10^{-4}$ | 44 | 8 | | X |
| 32 (comparison) | 2 | G 3 | H 1 | $1.9 \times 10^{-2}$ | $6.7 \times 10^{-3}$ | $1.5 \times 10^{-2}$ | $7.3 \times 10^{-4}$ | 41 | 16 | | X |
| 33 (comparison) | 2 | G 3 | H 3 | $1.4 \times 10^{-1}$ | $4.8 \times 10^{-3}$ | $6.0 \times 10^{-4}$ | $3.5 \times 10^{-4}$ | — | — | | X |

DISCHARGE LAMP WITH SPECIFIC AMOUNTS OF HALOGEN, OXYGEN, HYDROGEN AND CARBON

BACKGROUND OF THE INVENTION

1. Field of the Invention

The invention relates to a discharge lamp. The invention relates especially to a discharge lamp in which the discharge vessel is filled with mercury, a rare gas, with Ar as the main component, and bromine.

2. Description of Related Art

Recently, illumination devices for purposes of projection or image presentation apparatus have become common. Their light source is often a high pressure discharge lamp. In a liquid crystal projector, the light source is a discharge lamp of the short arc type because it approaches a point light source and because alignment adjustment is simple. In such a discharge lamp, there is a demand for high luminance.

However, in a discharge lamp with high luminance, it is regarded as disadvantageous that the temperature of the electrodes during operation becomes rather high so that, in this way, devitrification and blackening of the discharge vessel form prematurely, and that as a result a high lumen maintenance factor cannot be obtained over a long time.

As a measure for suppressing or for preventing devitrification and blackening of the discharge vessel in a discharge lamp, conventionally, the following measures have been proposed, for example, in patent specifications JP-A HEI 11-297268 (Publication 1), JP-A HEI 11-329350 (Publication 2), and JP-A 2002-75269 (Publication 3).

One measure involves the introduction of a halogen with a certain ratio into the discharge vessel (see publication 1 and the like); and in accordance with another measure the ratio of the maximum intensity of the emission spectra of hydrogen, oxygen, and compounds thereof to the intensity of the main emission spectrum of the rare gas in a glow discharge of the discharge lamp is adjusted to less than or equal to a certain value (see publication 2).

Furthermore, recently, to obtain a high lumen maintenance factor over a long time, a measure was proposed (see publication 3) in which the halogen cycle is activated, such that, by adjusting the discharge lamp, the ratio of the intensity of the spectrum of OH with a wavelength of 305 nm to the intensity of the spectrum of mercury with a wavelength of 404.7 nm in a glow discharge of the discharge lamp becomes greater than a certain value, a metallic substance which sprays from the electrodes reacts with the oxygen and the halogen which are present within the discharge vessel, and a metallic compound results and is then deposited again on the electrodes. However, in such a discharge lamp there are the following disadvantages:

On the silica glass tube comprising the discharge vessel and on the electrodes, carbon and hydrogen are dissolved or adsorbed on the surface. Furthermore, organic substances and water are adsorbed from the silica glass tube and the electrodes by the silica glass and the electrodes being exposed to the atmosphere in the production of the discharge lamp. As a result, carbon and hydrogen are introduced as impurities into the discharge vessel of the discharge lamp after production. When carbon and hydrogen are introduced into the discharge vessel, they react with oxygen within this discharge vessel, by which CO, $CO_2$, $H_2O$ and the like are formed. Therefore, the halogen cycle does not operate smoothly. As a result, a high lumen maintenance factor cannot be maintained over a long period of time.

The intensity of the spectrum of mercury in a glow discharge is subject to variances depending on the outside temperature environment, the type of discharge and the like of the discharge lamp. Therefore, it is difficult to control this spectral intensity with high precision.

SUMMARY OF THE INVENTION

The invention was devised to eliminate the above described disadvantages of the prior art. Thus, a primary object of the invention is to devise a discharge lamp in which, even during operation over a long period of time, a high lumen maintenance factor can be maintained.

In a discharge lamp which has a silica glass discharge vessel and a pair of opposed electrodes located in the discharge vessel, and in which the discharge vessel is filled with at least 0.15 mg/mm$^3$ of mercury and a rare gas, with argon as the main component, and with $2\times10^{-4}$ $\mu$mole/mm$^3$ to $7\times10^{-3}$ $\mu$mole/mm$^3$ of bromine, the indicated object of the invention is achieved in that the following conditions (1) to (4) are met where, in the case of feeding a direct current of 5 mA between the above described electrodes and in the case of carrying out a glow discharge, a is the emission intensity of the argon with a wavelength of 668 nm, b is the emission intensity of OH with a wavelength of 309 nm, c is the emission intensity of hydrogen (H) with a wavelength of 656 nm, d is the emission intensity of $C_2$ with a wavelength of 517 nm, and e is the emission intensity of CH with a wavelength of 431 nm.

$$1.0\times10^{-4} \leqq b/a \leqq 1.2\times10^{-1} \quad \text{Condition (1)}$$

$$c/a \leqq 1.4\times10^{-1} \quad \text{Condition (2)}$$

$$d/a \leqq 1.2\times10^{-2} \quad \text{Condition (3)}$$

$$e/a \leqq 1.4\times10^{-2} \quad \text{Condition (4)}$$

In the discharge lamp in accordance with the invention, it is advantageous that the concentration of the carbon compounds within the discharge vessel is at most 600 ppm.

Due to the above described arrangement in which conditions (1) to (4) are met, within the discharge space of a discharge vessel, a suitable amount of oxygen, and moreover, only few other impurities are present. Therefore, the halogen cycle functions smoothly. In this way, the blackening and devitrification of the discharge vessel are suppressed. As a result, even in the case of operation over a long period of time, a high lumen maintenance factor is maintained.

The invention is further described below with reference to several embodiments shown in the drawings.

BRIEF DESCRIPTION OF THE DRAWINGS

FIG. 2 is a schematic of important parts of the spectral measurement device for measurement of the emission intensity a to e of the discharge lamp;

FIG. 3 is a schematic of important parts of a gas analysis device for measurement of the concentration of carbon compounds within the discharge vessel;

FIGS. 4 & 5 are tables showing the results of tests on lamps in accordance with the invention and of comparison tests on lamps lacking the features of the present invention.

DETAILED DESCRIPTION OF THE INVENTION

Figure 1:
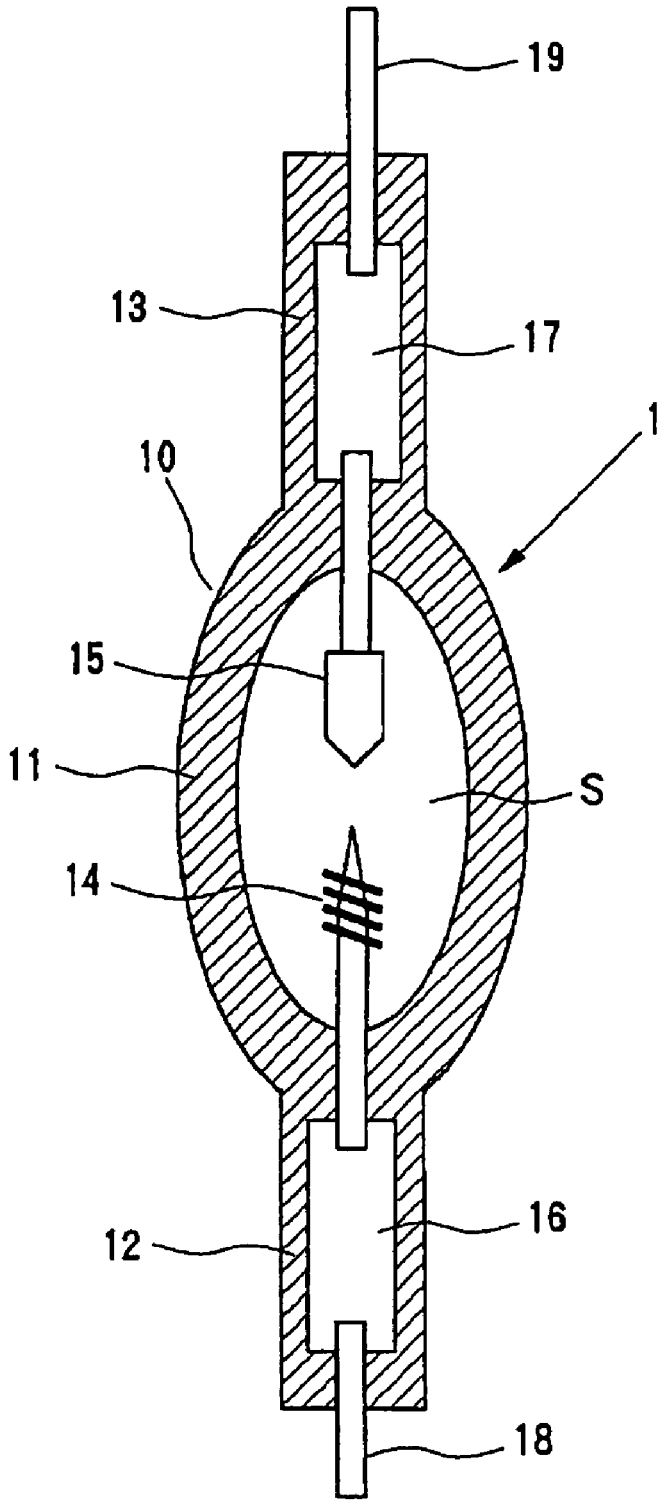
FIG. 1 is a schematic cross section of one example of the arrangement of a discharge lamp in accordance with the invention.

FIG. 1 is a schematic cross section of one example of the arrangement of a discharge lamp 1 in accordance with the invention which is driven by a direct current source.

The discharge lamp 1 shown in FIG. 1 has a silica glass discharge vessel 10 which is formed of an oval arc tube part 11 which surrounds a discharge space S and of hermetically sealed rod-shaped tube parts 12, 13 which adjoin the opposite ends of the arc tube part 11 and which extend outward in the axial direction of the tube.

In the discharge space S of the discharge vessel 10, there are cathode 14 and anode 15 electrodes, each of which is made of tungsten and which are arranged in opposition along the tube axis. In the hermetically sealed tube parts 12, 13 of the discharge vessel 10, metal foils 16, 17 of molybdenum are hermetically inserted. The base parts of the cathode 14 and of the anode 15 are attached and electrically connected to one end on the side of the arc tube part of the metal foil 16 or one end on the side of the arc tube part of the metal foil 17, for example, by spot welding or the like.

On the other ends of the metal foils 16, 17, outer lead pins 18, 19 extend along the axial direction of the tube of the discharge vessel 10. The lead pins 18, 19 project outward from the ends of the hermetically sealed tube parts 12, 13 and are attached and electrically connected, for example, by spot welding or the like.

The discharge space S of the discharge vessel 10 is filled at least with mercury, a rare gas, argon gas as the main component, and bromine. The amount of mercury added is fixed at greater than or equal to 0.15 mg/mm$^3$. In this way, a discharge lamp 1 with good color reproduction can be obtained.

The amount of bromine added is fixed in the range of at $2\times10^{-4}$ $\mu$mole/mm$^3$ to $7\times10^{-3}$ $\mu$mole/mm$^3$. If the added amount of bromine is at least $2\times10^{-4}$ $\mu$mole/mm$^3$, of the light which is emitted in the discharge space S, most of the UV radiation with short wavelengths is absorbed by bromine or by a bromine compound. The amount of UV radiation with short wavelengths which reaches the tube wall of the discharge vessel 10 is extremely small. As a result, milky opacification of the discharge vessel 10 can be suppressed. On the other hand, when less than or equal to $7\times10^{-3}$ $\mu$mole/mm$^3$ bromine has been added, the occurrence of deformation and wearing of the electrodes is suppressed.

It is advantageous for the filling pressure of the rare gas to be 3 kPa to 20 kPa. In this way, a discharge lamp with a small change of the emission intensity by Ar in glow discharge operation is obtained.

The rare gas can be pure Ar or a gas mixture of Ar and another rare gas (Xe, Kr or the like). When using a gas mixture, it is advantageous for the ratio of Ar to be greater than or equal to 80% by volume.

In a discharge lamp 1 in the case of supplying a direct current of 5 mA between the cathode 14 and the anode 15 and in the case of carrying out a glow discharge the following conditions are met where a is the emission intensity of the argon with a wavelength of 668 nm, b is the emission intensity of OH with a wavelength of 309 nm, c is the emission intensity of hydrogen (H) with a wavelength of 656 nm, d is the emission intensity of $C_2$ with a wavelength of 517 nm, and e is the emission intensity of CH with a wavelength of 431 nm.

$$1.0\times10^{-4} \leqq b/a \leqq 1.2\times10^{-1} \quad \text{Condition (1)}$$

$$c/a \leqq 1.4\times10^{-1} \quad \text{Condition (2)}$$

$$d/a \leqq 1.2\times10^{-2} \quad \text{Condition (3)}$$

$$e/a \leqq 1.4\times10^{-2} \quad \text{Condition (4)}$$

Here, the emission spectrum of OH with a wavelength of 309 nm, the emission spectrum of $C_2$ with a wavelength of 517 nm and the emission spectrum of CH with a wavelength of 431 nm are described in *The Identification of Molecular Spectra*, 4th edition, Chapman and Hall Ltd., London (1976) by R. W. B. Pearse and A. G. Gaydon.

If the value of the ratio b/a is less than $1.0\times10^{-4}$, the amount of oxygen is unduly low, resulting in the danger that the halogen cycle is not adequately activated and that the lumen maintenance factor diminishes. On the other hand, in the case in which the value of the ratio b/a is greater than $1.2\times10^{-1}$, the amount of oxygen is unduly large, by which the halogen cycle is overly activated. Tungsten as the electrode material is deposited on the tip of the cathode 14 to an excessive degree and this shortens the distance between the cathode 14 and the anode 15. As a result, the lamp voltage drops, by which there is the danger that the operating ballast is destroyed.

When the value of the ratio c/a is greater than $1.4\times10^{-1}$ within the discharge vessel 10, $H_2O$ is formed as an impurity. Therefore, it becomes difficult to maintain a high lumen maintenance factor over a long period of time.

In the case in which the value of the ratio d/a is greater than $1.2\times10^{-2}$ within the discharge vessel 10, CO and $CO_2$ are formed as impurities. It therefore becomes difficult to obtain a high lumen maintenance factor over a long time.

In the case in which the value of the ratio e/a is greater than $1.4\times10^{-2}$ within the discharge vessel 10, CO, $CO_2$ and $H_2O$ are formed as impurities. Therefore, it becomes difficult to obtain a high lumen maintenance factor over a long time.

In the measurement of the emission intensities a to e of the discharge lamp, the device described below is used.

FIG. 2 is a schematic of important parts of the spectral measurement device for measurement of the emission intensity a to e of the discharge lamp. In the figure, a spectroscope 20 has a diffraction grating 21, a diffraction grating rotating driver 22 for turning the diffraction grating 21 and a control device 23 which controls the diffraction grating rotating driver 22. An incidence slit is labeled 25. Furthermore, a CCD photodetector 30 is provided for determining the light from the spectroscope, a control device 35 is provided for controlling the CCD photodetector 30.

The slit width of the incidence slit 25 is, for example, 50 microns. In the diffraction grating 21 for the spectroscope 20, the number of notched lines is, for example, 1200 lines/mm and the reciprocal linear dispersion at a wavelength of 500 nm is, for example, 1.5 nm/mm.

Using the above described measurement device, the radiances a to e of the discharge lamp 1 are measured in the manner described below.

First, between the cathode 14 and the anode 15 of the discharge lamp 1, a direct current of 5 mA is supplied, and thus, a glow discharge is carried out. The light from the discharge lamp 1 is delivered to the spectroscope 20 via the incidence slit 25, broken down by the diffraction grating 21 in this spectroscope 20, emerges from the spectroscope 20 and is furthermore determined by the CCD photodetector 30. By turning the diffraction grating 21 for the spectroscope 20, registration takes place as a distribution of the light intensity in the scattering direction, i.e., as the spectrum, in the control device 35 with respect to the light from the spectroscope.

The wavelength resolution for the entire measurement device which comprises the spectroscope 20 and the CCD photodetector 30, here, fluctuates depending on the measured wavelength of the light and for example at a full width at half maximum (FWHM) is 0.05 nm to 0.08 nm.

Furthermore, it is known that the intensity of the emission spectrum is reduced by HgH in the course of the operating time of the discharge lamp (see, for example, Toshiji Kazui, Hiromitsu Masumo and Mikiya Yamane: J. Light & Vis. Env., Vol. 1, No. 2 (1977)10). For the same reason, over the course of operation of the discharge lamp, the intensity of the emission spectra of OH, $C_2$, CH and the like also decreases. Therefore, it is advantageous that the emission intensities a to e of the discharge lamp 1 are measured within 2 seconds after starting of the glow discharge in order to ensure the reproducibility in a repeated measurement. In the case of a repeated measurement, it is advantageous that the discharge lamp which has once been subjected to a glow discharge, for purposes of reset, undergoes nominal operation for 5 minutes and then is used for measurement.

In the discharge lamp according to the invention, the amounts of oxygen, hydrogen and carbon which are present in the discharge space S of the discharge vessel 10 are set to meet the above described conditions (1) to (4).

Specifically, for purposes of setting the oxygen which is present in the discharge space S of the discharge vessel 10 to a suitable amount, usually the discharge space S of the discharge vessel 10 is filled with $O_2$, together with mercury, a rare gas, with argon as the main component, and together with bromine. The amount of $O_2$ added is fixed within the range which meets the above described condition (1) according to the amount of Ar added in a suitable manner. However, it is advantageous for it to be in the range from 0.1% by volume to 1% by volume of the amount of Ar added.

In order to set the hydrogen and the carbon which are present in the discharge space S of the discharge vessel 10 to suitable amounts, specifically to reduce the amounts of the hydrogen and of the carbon, it is necessary to eliminate the hydrogen and the carbon which are adsorbed on the surfaces of the material which forms the discharge vessel and the electrodes or are dissolved in them. Normally the material (silica glass tube) comprising the discharge vessel 10 is subjected to vacuum degassing treatment, and moreover, the electrode material comprising the cathode 14 and the anode 15 is subjected to heat treatment.

As the conditions for vacuum degassing treatment of the material comprising the discharge vessel, it is advantageous for the treatment pressure to be at most $1\times10^{-4}$ Pa, for the treatment temperature to be 1000° C. to 1200° C. and for the treatment time to be at least 10 hours. Furthermore, as the conditions for the heat treatment of the electrode material, it is advantageous for the treatment pressure to be less than or equal to $1\times10^{-4}$ Pa, for the treatment temperature to be 1000° C. to 2300° C. and for the treatment time to be 10 minutes to 60 minutes.

In the discharge lamp in accordance with the invention, it is advantageous for the concentration of the carbon compounds in the discharge vessel 10 to be at most 600 ppm. In the case in which this concentration is greater than 600 ppm, the above described conditions (3) and (4) are not satisfied. Therefore, it is difficult to obtain a high lumen maintenance factor over a long time.

The concentration of the carbon compound in the discharge vessel 10 can be measured in the manner described below.

FIG. 3 is a schematic of important parts of the gas analysis device for measurement of the concentration of the carbon compounds in the discharge vessel. In this figure, there is shown a lamp destruction chamber 40 for destroying the discharge lamp 1, an inlet 41 for feeding normal gas to the lamp destruction chamber 40, a crushing device 42, a precision flow control valve 43, a quadrupole mass analyzer 44, a tapping valve 45, a turbo-molecular pump 46 and a rotary pump 47.

In the analysis device, a calibration curve for determining the concentration of carbon changes is produced beforehand. Based on this calibration curve, the concentration of the carbon compounds within the discharge vessel is measured. This calibration curve can be produced, for example, in the manner described below.

First, a normal gas is produced which is composed of argon gas which contains carbon compounds, for example, $CH_4$, CO or $CO_2$ with a suitable concentration. Next, the normal gas is delivered from the inlet for delivery of normal gas to the lamp destruction chamber 40. This normal gas is delivered via the precision flow control valve to the quadrupole mass analyzer 44 and is subjected to mass spectrometric analysis. By carrying out this operation using normal gas with different concentrations of carbon compounds, for example, using normal gas which contains carbon compounds with concentrations of 100 ppm, 1000 ppm, and 5000 ppm, a calibration curve for determining the concentration of the respective carbon compounds can be produced.

The process for measurement of the carbon concentration within the discharge vessel is described below. First, the discharge lamp 1 is placed in the lamp destruction chamber 40 and the destruction chamber 40 is pumped to a high vacuum, for example, in the range of $10^{-7}$ Pa. Next, the discharge lamp 1 is destroyed by the crushing device 42 by surface pressures. Afterwards, the emitted gas is delivered to the quadrupole mass analyzer 44 via the precision flow control valve and analyzed using mass spectrometry. With this analysis result, using the calibration curve, the concentration of the carbon compounds is determined.

By means of the discharge lamp 1 in accordance with the invention, the above described conditions (1) to (4) are met. In this way, in the discharge space S of the discharge vessel 10, a suitable amount of oxygen, and at the same time, only a small amount of other impurities, are present. Therefore, the halogen cycle operates smoothly. In this way, blackening and devitrification of the discharge vessel 10 are suppressed. As a result, even with operation over a long period of time, a high lumen maintenance factor can be maintained.

EMBODIMENTS

The discharge lamp in accordance with the invention is described below using specific embodiments. But the invention is not limited to them.

According to the arrangement shown in FIG. 1, a total of 33 types of discharge lamps containing different amounts of oxygen, different vacuum degassing conditions of the materials comprising the discharge vessel, or different heat treatment conditions of the electrodes were produced.

Particular specifications of the discharge vessel, the electrodes, the contents, and the electrical properties in these discharge lamps are described below.

(Discharge Vessel)

The discharge vessel (10) is made of silica glass and has a total length of 60 mm. The outside diameter of the arc tube part (11) is 10 mm. Its inside diameter is 5 mm. The volume of the discharge space (S) is roughly 80 $mm^3$. The respective length of the hermetically sealed tube parts (12, 13) is 25 mm, and their outside diameter is 5 mm.

For vacuum degassing treatment of the material comprising the discharge vessel the following three conditions were imposed:

without treatment (called "condition G1")

treatment condition under which the treatment pressure is $5\times10^{-5}$ Pa, the treatment temperature is 1150° C. and the treatment time is 10 hours (called "condition G2")

The treatment pressure is $5\times10^{-5}$ Pa, the treatment temperature is 1150° C. and the treatment time is 40 hours (called "condition G3").

(Electrodes)

The cathode 14 and the anode 15 each is made of tungsten. The distance between the cathode 14 and the anode 15 is 1.2 mm. For heat treatment of the cathode 14 and the anode 15, the following three conditions are imposed:

without treatment (called "condition H1")

treatment condition under which the treatment pressure is $8\times10^{-5}$ Pa, the treatment temperature is 1000° C. and the treatment time is 30 minutes (called "condition H2")

treatment condition under which the treatment pressure is $8\times10^{-5}$ Pa, the treatment temperature is 2200° C. and the treatment time is 30 hours (called "condition H3").

(Fillers)

The substances which are added to the discharge vessel 10 were roughly 20 mg (roughly 0.25 $mg/mm^3$) of mercury, 5×10–4 $\mu mole/mm^3$ bromine, Ar with a filling pressure of 13.3 kPa, and $O_2$ in the following amounts:

0% by volume of the amount of Ar 0.1% by volume of the amount of Ar 0.5% by volume of the amount of Ar 1% by volume of the amount of Ar 2% by volume of the amount of Ar.

(Electrical Properties)

In these discharge lamps, the lamp voltage is 66.7 V to 100 V, the lamp current is 2 A to 3 A and the lamp wattage is 200 W.

In these discharge lamps, between the cathode and the anode, a direct current of 5 mA is supplied, and thus, a glow discharge is carried out. Using the spectral measurement device shown in FIG. 2, the emission intensities a through e were measured within 2 seconds after the start of the glow discharge and ratios b/a, c/a, d/a and e/a were determined. Here, the spectroscope in the spectral measurement device was the device "G-500III" from Nikon AG. The CCD photodetector was a CCD detector of the thermoelectric cooling type "DV-420" from Andor Technology.

Next, the discharge lamps were operated with the rated values, the initial illuminance and the initial lamp voltage were measured, and moreover, the illuminance and the lamp voltage were measured after 1000 hours of operation and the growth values of the lumen maintenance factor and the lamp voltage were determined. The discharge lamps with a lumen maintenance factor of at least 80% (i.e., the lamps maintained at least 80% of their initial illuminance) were labeled with o and the discharge lamps with a lumen maintenance factor of less than 80% were labeled x and evaluated accordingly.

Furthermore, using the gas analyzer shown in FIG. 3, the concentrations of the carbon compounds within the discharge vessel of the respective discharge lamp were measured. Here, the measurement objects were the carbon compounds $CH_4$, CO and $CO_2$. The normal gas was Ar gas which contained $CH_4$, CO, and $CO_2$ in an amount of 100 ppm, 1000 ppm and 5000 ppm, respectively. In this way, a calibration curve was produced.

The results are shown in FIGS. 4 and 5.

As is apparent from the results shown in FIGS. 4 and 5, the discharge lamps of the invention, even after 1000 hours of operation, yielded a lumen maintenance factor of at least 80%. Furthermore, it was confirmed that all concentrations of the carbon compounds within the discharge vessel in these discharge lamps were at most 600 ppm.

In all discharge lamps for comparison purposes, conversely, the lumen maintenance factor after operation of 1000 hours was less than or equal to 55%.

In the discharge lamp with number 33 in FIG. 5, the operating load increased due to the increase of the lamp current. Therefore, this discharge lamp could not be operated for 1000 hours. It can be imagined that the reason for this is that the tungsten, as the electrode material, accumulated on the cathode tip and that, therefore, the distance between the electrodes became shorter.

Action of the Invention

As was described above, in accordance with the invention, a discharge lamp can be devised in which even when operated over a long period of time a high lumen maintenance factor can be maintained.

What is claimed is:

1. Discharge lamp, comprising:

a silica glass discharge vessel having a discharge space, and a pair of opposed electrodes located in the discharge vessel, wherein the discharge vessel contains at least 0.15 $mg/mm^3$ of mercury and a rare gas having argon as a main component, and bromine in an amount in a range of $2\times10^{-4}$ $\mu mole/mm^3$ to $7\times10^{-3}$ $\mu mole/mm^3$, wherein amounts of oxygen, hydrogen and carbon which are present in the discharge space of the discharge vessel have been set so as to meet the following conditions (1) to (4) when a direct current of 5 mA is fed between the above described electrodes and a glow discharge produced:

$$1.0\times10^{-4}\leqq b/a\leqq1.2\times10^{-1} \quad \text{Condition (1)}$$

$$c/a\leqq1.4\times10^{-1} \quad \text{Condition (2)}$$

$$d/a\leqq1.2\times10^{-2} \quad \text{Condition (3)}$$

$$e/a\leqq1.4\times10^{-2} \quad \text{Condition (4)}$$

where a is the emission intensity of the argon with a wavelength of 668 nm, b is the emission intensity of OH with a wavelength of 309 nm, c is the emission intensity of hydrogen (H) with a wavelength of 656 nm, d is the emission intensity of $C_2$ with a wavelength of 517 nm, and e is the emission intensity of the CH with a wavelength of 431 nm.

2. Discharge lamp as claimed in claim 1, wherein the concentration of the carbon compounds within the discharge vessel is less than or equal to 600 ppm.

3. Discharge lamp as claimed in claim 1, wherein the amount of oxygen in the discharge space is in a range from 0.1% by volume to 1% by volume of the amount of argon.

4. Method of producing a discharge lamp comprising the steps of:

providing a silica glass discharge vessel having a discharge space, locating a pair of opposed electrodes located in the discharge vessel, and filling the discharge vessel with at least 0.15 mg/mm$^3$ of mercury and a rare gas having argon as a main component, and bromine in an amount in a range of $2\times10^{-4}$ $\mu$mole/mm$^3$ to $7\times10^{-3}$ $\mu$mole/mm$^3$, setting amounts of oxygen, hydrogen and carbon which are present in the discharge space of the discharge vessel so as to meet the following conditions (1) to (4) when a direct current of 5 mA is fed between the above described electrodes and a glow discharge produced:

$$1.0\times10^{-4} \leqq b/a \leqq 1.2\times10^{-1} \quad \text{Condition (1)}$$

$$c/a \leqq 1.4\times10^{-1} \quad \text{Condition (2)}$$

$$d/a \leqq 1.2\times10^{-2} \quad \text{Condition (3)}$$

$$e/a \leqq 1.4\times10^{-2} \quad \text{Condition (4)}$$

where a is the emission intensity of the argon with a wavelength of 668 nm, b is the emission intensity of OH with a wavelength of 309 nm, c is the emission intensity of hydrogen (H) with a wavelength of 656 nm, d is the emission intensity of $C_2$ with a wavelength of 517 nm, and e is the emission intensity of CH with a wavelength of 431 nm.

5. Method according to claim 4, wherein the concentration of the carbon compounds within the discharge vessel is set at less than or equal to 600 ppm.

6. Method as claimed in claim 4, wherein the amount of oxygen in the discharge space is set in a range from 0.1% by volume to 1% by volume of the amount of argon.

7. Method as claimed in claim 4, wherein the electrode material comprising the electrodes has been subjected to heat treatment at a temperature of from 1000° C. to 2300° C. and a treatment pressure of less than or equal to $1\times10^{-4}$ Pa for a treatment time of from 10 minutes to 60 minutes.

8. Method as claimed in claim 4, wherein the material comprising the discharge vessel has been subjected to heat treatment at a temperature of from 1000° C. to 1200° C. and a treatment pressure of less than or equal to $1\times10^{-4}$ Pa for a treatment time of at least 10 hours.

* * * * *